US006065436A

United States Patent [19]

Koga et al.

[11] Patent Number: 6,065,436

[45] Date of Patent: May 23, 2000

[54] DEVICE FOR CONTROLLING FUEL INJECTION INTO AN INTERNAL COMBUSTION ENGINE

[75] Inventors: Nobuhiko Koga; Susumu Kojima, both of Susono; Keiso Takeda, Mishima; Kosuke Suzui, Susono, all of Japan

[73] Assignee: Toyota Jidosha Kabushiki Kaisha, Toyota, Japan

[21] Appl. No.: 09/370,239

[22] Filed: Aug. 9, 1999

[30] Foreign Application Priority Data

Aug. 11, 1998 [JP] Japan ..... 10-226908

[51] Int. Cl.[7] ..... F02N 17/00

[52] U.S. Cl. ..... 123/179.17; 123/456

[58] Field of Search ..... 123/179.17, 456, 123/506, 446, 447, 516

[56] References Cited

U.S. PATENT DOCUMENTS

| | | | |
|---|---|---|---|
| 5,529,042 | 6/1996 | Augustin | 123/506 |
| 5,598,817 | 2/1997 | Igarashi | 123/179.17 |
| 5,642,716 | 7/1997 | Ricco | 123/456 |
| 5,758,622 | 6/1998 | Rebold | 123/179.17 |
| 5,794,586 | 8/1998 | Oda | 123/179.17 |
| 5,911,208 | 6/1999 | Furusawa | 123/456 |
| 5,918,578 | 7/1999 | Oda | 123/456 |

FOREIGN PATENT DOCUMENTS

| | | |
|---|---|---|
| 9-250426 | 9/1997 | Japan . |
| 10-176619 | 6/1998 | Japan . |

*Primary Examiner*—Carl S. Miller
*Attorney, Agent, or Firm*—Oliff & Berridge, PLC

[57] ABSTRACT

A device for controlling fuel injection into an internal combustion engine is disclosed. The device comprises an accumulator for supplying pressurized fuel to a fuel injection valve, a high-pressure pump for discharging fuel into the accumulator using the engine as a power source, and a low-pressure pump for discharging fuel into the high-pressure pump using a power source other than the engine. At the start of the engine, the fuel discharged from the low-pressure pump is substantially directly introduced into the accumulator through a pump chamber of the high-pressure pump. To elevate the pressure within the accumulator for a short period to a fuel pressure capable of injecting fuel at the start of the engine, an opening and closing valve is provided in a suction passage that communicates the discharge side of the low-pressure pump with the suction side of the high-pressure pump, and is maintained to be opened at the start of the engine.

10 Claims, 7 Drawing Sheets

DEVICE FOR CONTROLLING FUEL INJECTION INTO AN INTERNAL COMBUSTION ENGINE

BACKGROUND OF THE INVENTION

1. Field of the Invention

The present invention relates to a device for controlling fuel injection into an internal combustion engine.

2. Description of the Related Art

There has heretofore been known a fuel injection device which has an accumulator, for accumulating fuel of a high pressure, and injects fuel from the accumulator through a fuel injection valve disposed for each of the cylinders in order to inject fuel of a high pressure directly into the cylinder. In such fuel injection device, in general, fuel is sent at a high pressure into the accumulator periodically by a high-pressure pump driven by the engine, and fuel in the accumulator maintains nearly a predetermined high pressure. Further, an electrically driven low-pressure pump is disposed between the high-pressure pump and a fuel tank, so that the pressure of fuel to be sucked by the high-pressure pump is elevated to a predetermined low fuel pressure higher than the atmospheric pressure, in order to prevent generation of vapor in the fuel discharged from the high-pressure pump.

In the fuel injection device, the pressure of fuel in the accumulator must be quickly elevated to be capable of injecting fuel at the start of the engine. With the high-pressure pump being rotated at a very low speed by cranking, however, the discharge efficiency of the high-pressure pump is so low that a relatively long period is required before the pressure of fuel in the accumulator is elevated to a pressure capable of injecting fuel.

In order to solve this problem, Japanese Unexamined Patent Publication (Kokai) No. 9-250426 discloses a fuel injection device in which a normally closed bypass passage for bypassing the high-pressure pump is provided to communicate the low-pressure pump with the accumulator, and the bypass passage is opened at the start of the engine so that fuel discharged from the low-pressure pump is directly introduced into the accumulator. The low-pressure pump is electrically powered, and therefore provides a high discharge efficiency from the start of the engine. Whereby, this fuel injection device enables the pressure of fuel in the accumulator to be elevated quickly to a predetermined low fuel pressure, so that the fuel can be injected at this fuel pressure.

However, provision of the bypass passage makes the structure of the fuel injection device complex and causes cost. Therefore, the above-mentioned related art also discloses a fuel injection device in which a check valve is disposed in a suction passage that communicates the discharge side of the low-pressure pump with the suction side of the high-pressure pump to permit only the flow of fuel from the low-pressure pump into the high-pressure pump, and the bypass passage is omitted. In this fuel injection device, it is intended to directly introduce the fuel discharged from the low-pressure pump into the accumulator through a pump chamber of the high-pressure pump when the fuel pressure within the accumulator is lower than a predetermined pressure at the start of the engine.

In the above-mentioned fuel injection device in which the bypass passage is omitted, fuel discharged from the low-pressure pump can be substantially directly introduced into the accumulator when the pressures within the accumulator and within the pump chamber of the high-pressure pump are lower than a predetermined low fuel pressure. On the other hand, when the high-pressure pump starts the discharge stroke by the cranking at the start of the engine, the fuel pressure within the pump chamber of the high-pressure pump rises above the predetermined low fuel pressure. During this period, therefore, the check valve in the suction passage is closed, and the fuel discharged from the low-pressure pump cannot be supplied to the accumulator. Accordingly, the period is extended before the pressure within the accumulator is elevated to nearly a predetermined low fuel pressure with which the fuel can be injected, and the starting performance of the engine cannot be improved as intended.

SUMMARY OF THE INVENTION

The object of the present invention, therefore, is to provide a device for controlling fuel injection into an internal combustion engine comprising an accumulator for supplying pressurized fuel to a fuel injection valve, a high-pressure pump for discharging fuel into the accumulator using the engine as a power source, and a low-pressure pump for discharging fuel into the high-pressure pump using a power source other than the engine, wherein, at the start of the engine, the fuel discharged from the low-pressure pump is substantially directly introduced into the accumulator through a pump chamber of the high-pressure pump, and which device can elevate the pressure within the accumulator to a fuel pressure capable of injecting fuel at the start of the engine for a short period, in order to reliably improve the starting performance of the engine.

According to the present invention, there is provided a first device for controlling fuel injection into an internal combustion engine comprising an accumulator for supplying pressurized fuel to a fuel injection valve, a high-pressure pump for discharging fuel into the accumulator using the engine as a power source, and a low-pressure pump for discharging fuel into the high-pressure pump using a power source other than the engine, at the start of the engine, the fuel discharged from the low-pressure pump being substantially directly introduced into the accumulator through a pump chamber of the high-pressure pump, wherein an opening and closing valve is provided in a suction passage that communicates the discharge side of the low-pressure pump with the suction side of the high-pressure pump, and the opening and closing valve is maintained to be opened at the start of the engine.

According to the present invention, there is provided a second device for controlling fuel injection into an internal combustion engine comprising an accumulator for supplying pressurized fuel to a fuel injection valve, a high-pressure pump for discharging fuel into the accumulator using the engine as a power source, and a low-pressure pump for discharging fuel into the high-pressure pump using a power source other than the engine, at the start of the engine, the fuel discharged from the low-pressure pump being substantially directly introduced into the accumulator through a pump chamber of the high-pressure pump, wherein a check valve is provided in a suction passage that communicates the discharge side of the low-pressure pump with the suction side of the high-pressure pump to permit only the flow of fuel from the low-pressure pump into the high-pressure pump, and a high-pressure pump halting means is provided for halting the operation of the high-pressure pump at the start of the engine.

DESCRIPTION OF THE PREFERRED EMBODIMENTS

Figure 1:
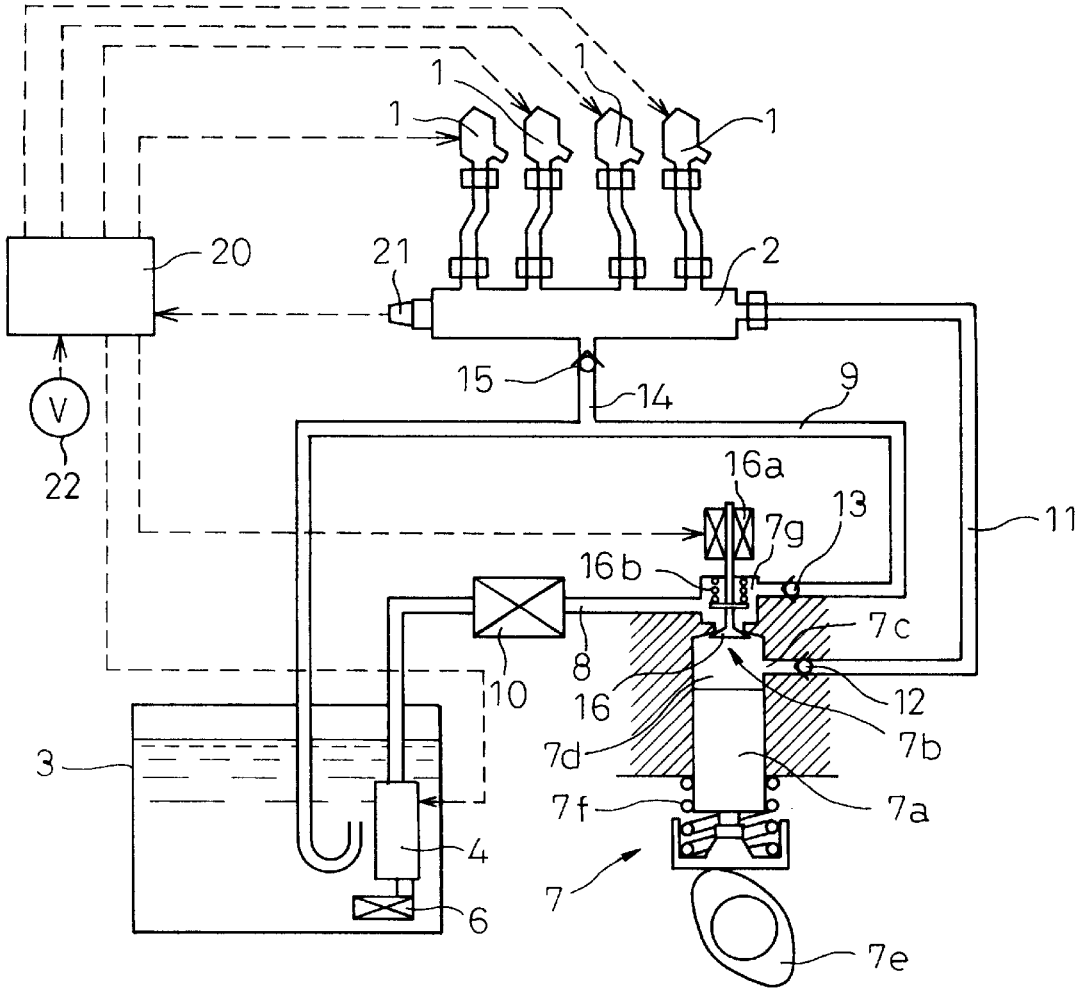
FIG. 1 is a view schematically illustrating a device for controlling fuel injection into an internal combustion engine according to a first embodiment of the present invention.

FIG. 1 is a view schematically illustrating a device for controlling fuel injection into an internal combustion engine according to a first embodiment of the present invention. The embodiment described below deals with an internal combustion engine having four cylinders which, however, is not to limit the present invention. In FIG. 1, reference numeral 1 denotes four fuel injection valves disposed for the cylinders, and 2 is an accumulator for supplying fuel of a high pressure to the fuel injection valves 1. Reference numeral 3 denotes a fuel tank in which a low-pressure pump 4 is disposed. The low-pressure pump 4 is an electric pump driven by a battery and has a rated discharge pressure (PL) of, for example, 0.3 MPa. Reference numeral 6 denotes a filter for removing foreign matter from the fuel sucked by the low-pressure pump 4.

Reference numeral 7 denotes a high-pressure pump for elevating the pressure within the accumulator 2 to near a predetermined high fuel pressure (PH) of, for example, 10 MPa. The high-pressure pump 7 has a plunger 7*a* that can slide in the cylinder. A pump chamber is formed by space 7*d* in the cylinder of the high-pressure pump 7 that has a suction side opening 7*b* and a discharge side opening 7*c*. The sliding operation of the plunger 7*a* for reducing the size of the pump chamber 7*d*, i.e., the discharge stroke operation of the plunger 7*a*, is produced by a cam 7*e* coupled to the crankshaft of the engine. The sliding operation of the plunger 7*a* for increasing the size of the pump chamber 7*d*, i.e., the suction stroke operation of the plunger 7*a*, is produced by a compression spring 7*f*. In this embodiment, the cam 7*e* produces two discharge strokes as it rotates once. Here, the cam 7*e* is coupled to the crankshaft through a reduction gear and the like, so that one rotation of the cam 7*e* corresponds to two rotations of the crankshaft; i.e., the discharge stroke of the high-pressure pump 7 is produced for every fuel injection into the two cylinders.

The suction side opening 7*b* of the pump chamber 7*d* is communicated with a control chamber 7*g*. The control chamber 7*g* is connected to the discharge side of the low-pressure pump 4 through a suction pipe 8 and is further connected to the fuel tank 3 through a return pipe 9. The suction pipe 8 is provided with a filter 10 for removing foreign matter from fuel discharged from the low-pressure pump 4.

The discharge side opening 7*c* of the pump chamber 7*d* is connected to the accumulator 2 through a discharge pipe 11. The discharge pipe 11 is provided with a check valve 12 that permits only the flow of fuel into the accumulator 2. The check valve 12 opens even under a very small differential pressure.

The return pipe 9 is provided with a first relief valve 13 that permits only the flow of fuel to the fuel tank 3. The return pipe 9 on the downstream side of the first relief valve 13 is connected to the accumulator 2 through a connection pipe 14. The connection pipe 14 is provided with a second relief valve 15 which permits only the flow of fuel from the accumulator 2. The first relief valve 13 is opened by a pressure slightly greater than the rated discharge pressure (PL) of the low-pressure pump 4. The second relief valve 15 is opened when the pressure within the accumulator 2 acquires a predetermined pressure higher than the predetermined high fuel pressure (PH), and thus prevents an abnormal increase in fuel pressure within the accumulator 2.

Reference numeral 16 denotes an electromagnetic valve for opening or closing the suction side opening 7*b* of the high-pressure pump 7. The electromagnetic valve 16 is closed upon energizing an electric solenoid 16*a*, and is opened by a spring 16*b* upon de-energizing the electric solenoid 16*a*. The electromagnetic valve 16 is opened in the suction stroke of the high-pressure pump 7, and is closed for only a required period during the discharge stroke. During the suction stroke of the high-pressure pump 7, therefore, the pump chamber 7*d* sucks the fuel discharged from the low-pressure pump 4. When the electromagnetic valve 16 is closed during the discharge stroke, the fuel in the pump chamber 7*d* is sent into the accumulator 2 through the discharge pipe 11. On the other hand, when the fuel pressure within the accumulator 2 is higher than the pressure for opening the first relief valve 13 while the electromagnetic valve 16 is opened in the discharge stroke, fuel in the pump chamber 7*d* is returned back to the fuel tank 3 through the return pipe 9. When the fuel pressure within the accumulator 2 is lower than the pressure for opening the first relief valve 13, the fuel in the pump chamber 7*d* is sent into the accumulator 2 through the discharge pipe 11.

Reference numeral 20 denotes an electronic control unit (ECU) for controlling an amount of injected fuel through each fuel injection valve 1, for controlling the operation of the electromagnetic valve 16 through the electric solenoid 16*a*, and for controlling the operation of the low-pressure pump 4. The ECU 20 is constructed as a digital computer and includes a ROM (read only memory), a RAM (random access memory), a CPU (microprocessor, etc.), an input port, and an output port (which are not shown). The ROM, the RAM, the CPU, the input port, and the output port are interconnected by a bidirectional bus. The fuel injection valves 1, the electric solenoid 16*a*, and the low-pressure pump 4 are connected to the output port of the ECU 20 via each drive circuit. A pressure sensor 21 for detecting a fuel pressure with the accumulator 2, and a voltmeter 22 for detecting a voltage of a battery for operating the low-pressure pump 4 are connected to the input port of the ECU 20 via each AD converter. Various sensors for determining a current engine operating condition, for example, an air flow meter, an engine speed sensor, a cooling water temperature sensor, and the like (not shown) are connected to the input port of the ECU 20.

Figure 2:
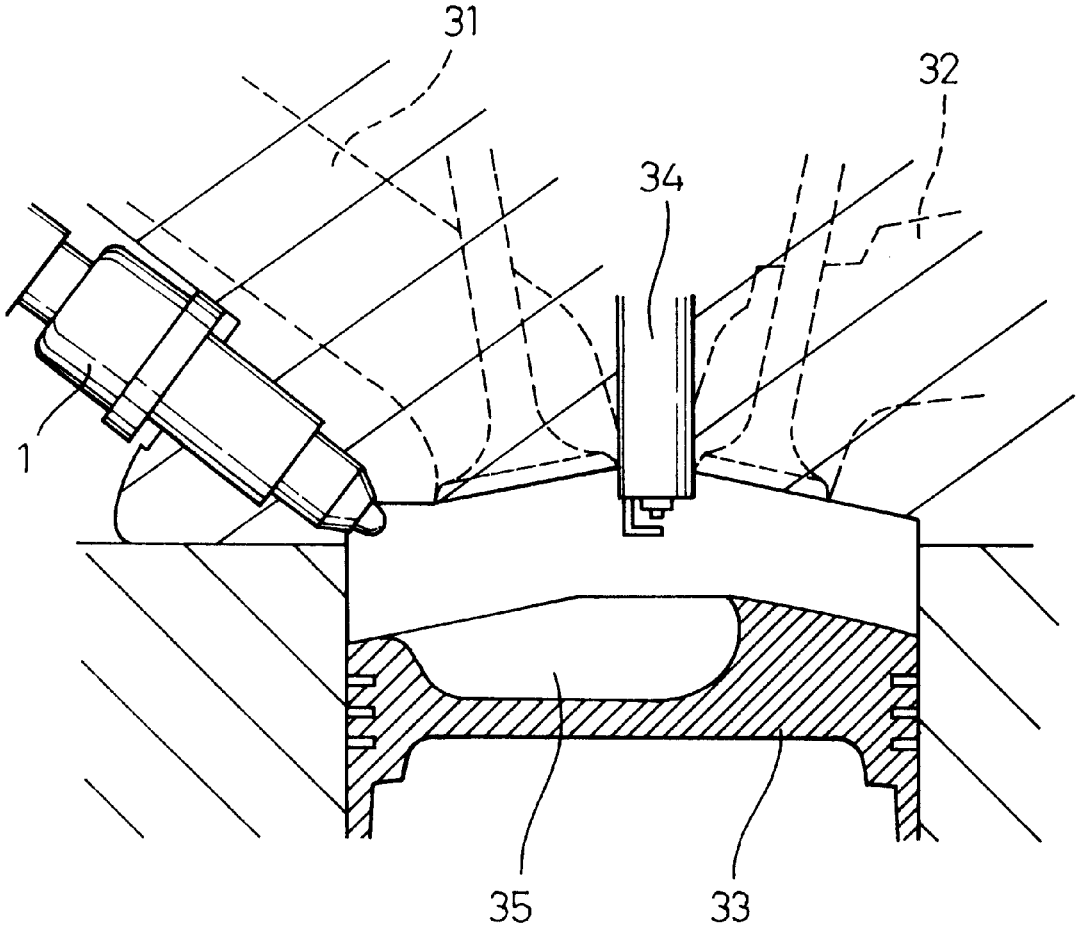
FIG. 2 is a sectional view illustrating a direct cylinder injection type spark-ignition internal combustion engine in which the device for controlling fuel injection according to the present invention can be mounted.

FIG. 2 is a sectional view illustrating a direct cylinder injection type spark-ignition internal combustion engine in which the device for controlling fuel injection according to the present invention can be mounted. In FIG. 2, reference numeral 31 denotes an intake port and 32 denotes an exhaust port. Reference numeral 33 denotes a piston, and 34 denotes a spark plug. A concave cavity 35 is formed on the top surface of the piston 33.

In a homogeneous combustion region where a high engine output is required, the fuel injection valve 1 injects a required amount of fuel in the intake stroke thereby to form a homogeneous mixture in the cylinder at the ignition timing. On the other hand, in a stratified charge combustion region, the fuel injection valve 1 injects a required amount of fuel in the latter half of the compression stroke. The injected fuel proceeds into the cavity 35, is deflected toward the spark plug 34 by the shape of the cavity 35, and forms a combustible mixture only near the spark plug 34 at the ignition timing.

Figure 3:
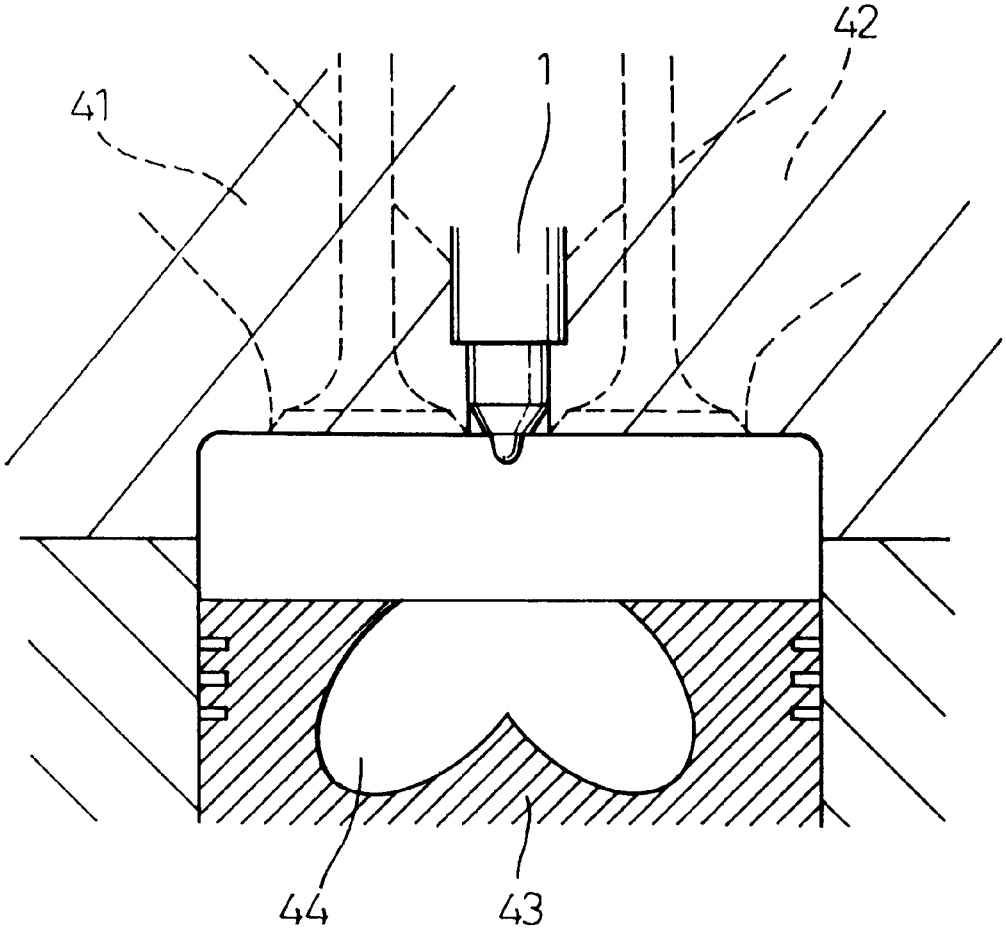
FIG. 3 is a sectional view illustrating a diesel engine in which the device for controlling fuel injection according to the present invention can be mounted.

FIG. 3 is a sectional view illustrating a diesel engine in which the device for controlling fuel injection according to the present invention can be mounted. In FIG. 3, reference numeral 41 denotes an intake port and 42 denotes an exhaust port. Reference numeral 43 denotes a piston. A combustion chamber 44 is formed on the top surface of the piston 43.

The fuel injection valve 1 injects a required amount of fuel in the latter half of the compression stroke. The injected fuel proceeds into the combustion chamber 44, is sufficiently mixed with the high compression and high temperature gas in the combustion chamber, and burned.

The device for controlling fuel injection according to the present invention can be mounted in the other type internal combustion engine, for example, in an intake port injection type spark-ignition internal combustion engine and the like.

Figure 4:
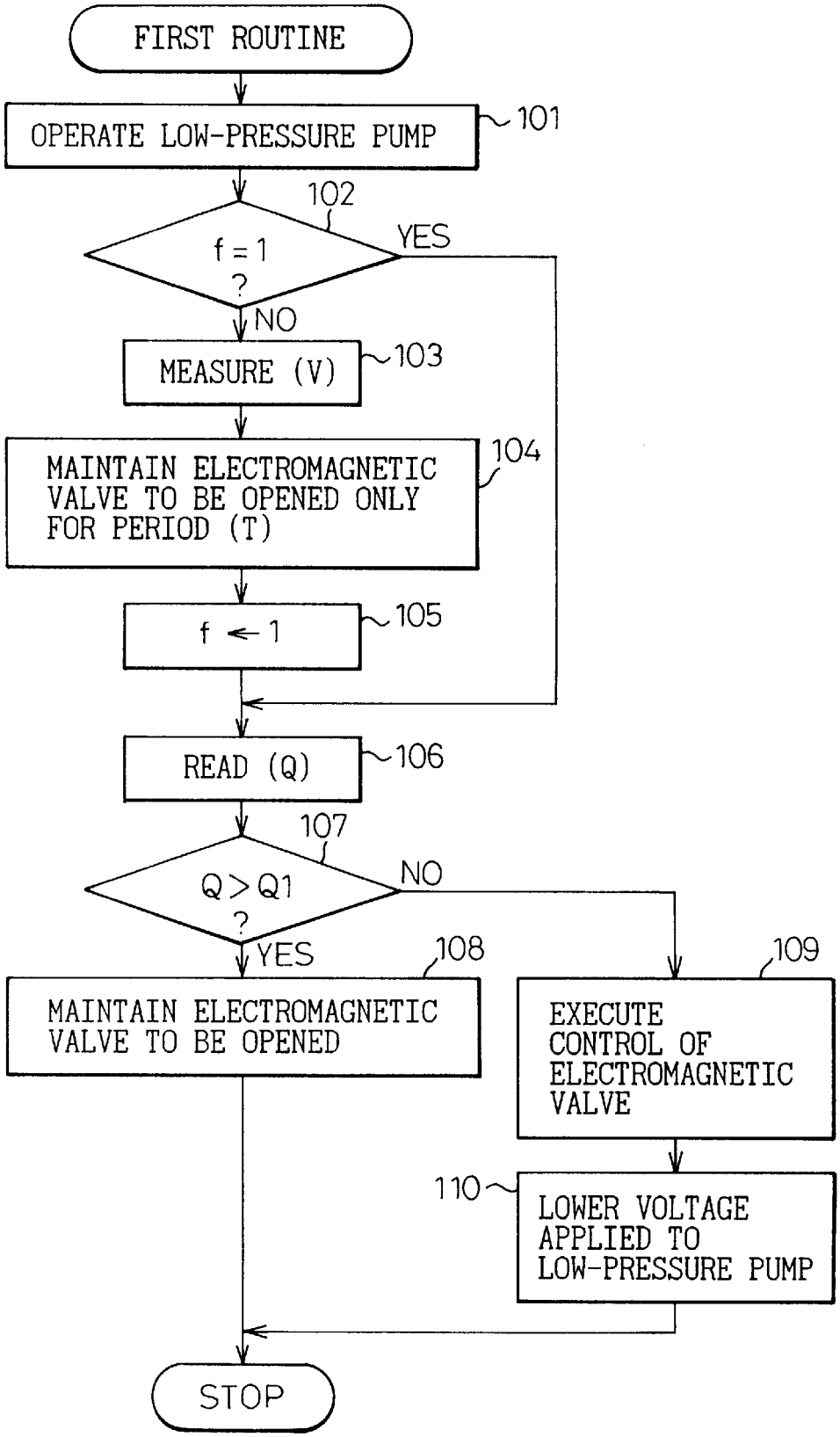
FIG. 4 is a first routine for controlling the operation of a low-pressure pump and for controlling the operation of an electromagnetic valve.

FIG. 4 is a first routine for controlling the operation of the electromagnetic valve 16 and for controlling the operation of the low-pressure pump 4 by the ECU 20. The first routine is executed as the starter switch is turned on, and is repeated every predetermined period. At step 101, first, the low-pressure pump 4 is operated. Then, it is determined at step 102 if a flag (f) is (1). The flag (f) is reset to (0) as the engine is brought into a halt. Therefore, initially the result is negative, and the routine goes to step 103 where a current voltage (V) of the battery is measured by the voltmeter 22.

The fuel discharge ability of the low-pressure pump 4 is determined depending on the voltage (V) of the battery which is a drive source. When the battery deteriorates, or when other devices are used in addition to the starter motor, the voltage (v) of the battery decreases and, hence, the fuel discharge ability of the low-pressure pump 4 decreases.

Next, the routine goes to step 104 where a period (T) for elevating the fuel pressure within the accumulator 2 from the atmospheric pressure to a fuel pressure capable of injecting fuel, is calculated on the basis of the fuel discharge ability of the low-pressure pump 4 that varies depending upon the voltage (V) of the battery, and the electromagnetic valve 16 is maintained to be opened only for this period (T). The high-pressure pump 7 is driven by the engine. During the cranking at a very low speed at the start of the engine, therefore, even if the electromagnetic valve 16 is closed over the whole discharge stroke, the discharge efficiency is low, i.e., an amount of discharged fuel is relatively small per a unit time, so that a relatively long period is required for elevating the fuel pressure within the accumulator 2 to a fuel pressure capable of injecting fuel.

In the present routine, at this time, the electromagnetic valve 16 is maintained to be opened irrespective of the suction stroke and the discharge stroke of the high-pressure pump 7, and fuel discharged from the low-pressure pump 4 is substantially directly introduced into the accumulator 2 through the pump chamber 7*d* of the high-pressure pump 7. Here, the first relief valve 13 disposed in the return pipe 9 is not opened, and therefore fuel discharged from the low-pressure pump 4 does not return back to the fuel tank 3.

The low-pressure pump 4 is driven by the battery which is a drive source other than the engine, and can be driven at a high speed even during the cranking and thus can discharge a relatively large amount of fuel per a unit time. By substantially directly introducing fuel discharged from the low-pressure pump 4 into the accumulator 2, therefore, fuel pressure within the accumulator 2 can be elevated for a very short period to a fuel pressure near the rated discharge pressure (PL) at which the fuel can be injected.

Thus, when the fuel pressure within the accumulator 2 is elevated to a pressure capable of injecting fuel at step 104, the flag (f) is set to (1) at step 105, and the routine goes to step 106. After the flag (f) is set to (1), the result at step 102 is affirmative, and the routine goes directly to step 106.

At step 106, a required amount of injected fuel (Q) calculated in the control of the amount of injected fuel for setting a period for opening the fuel injection valve is read and at step 107, it is determined if the required amount of injected fuel (Q) is larger than a maximum amount of discharged fuel (Q1) of the high-pressure pump 7 for one cylinder. In this embodiment, the amount of discharged fuel at one time by the high-pressure pump 7 corresponds to the amount of injected fuel for two cylinders. Therefore, the maximum amount of discharged fuel (Q1) corresponds to the half of the amount of discharged fuel when the electromagnetic valve 16 is closed over the whole discharge stroke of the high-pressure pump 7.

In an ordinary engine operating condition after the start of the engine, the required amount of fuel (Q) in high engine load and high engine speed operating conditions does not exceed the maximum amount of discharged fuel (Q1). In particular, at the cold start of the engine, the injected fuel is poorly atomized and contributes, in only small amounts, to the combustion. Therefore, the required amount of fuel (Q) becomes very large, and exceeds the maximum amount of discharged fuel (Q1). At this time, if fuel is discharged from the high-pressure pump 7 by the control of the electromagnetic valve 16, an amount of fuel injected from the accumulator 2 is larger than an amount of fuel discharged into the accumulator 2, and thus the pressure within the accumulator 2 quickly decreases down to near atmospheric pressure, and a desired amount of fuel is no longer injected.

In the present routine, therefore, when the result at the step 107 is affirmative, the routine goes to step 108 where the electromagnetic valve 16 is maintained to be opened so that a relatively large amount of fuel discharged from the low-pressure pump 4 per a unit time is substantially directly introduced into the accumulator 2. Thus, even if a large amount of fuel is injected from the accumulator 2, the fuel pressure within the accumulator 2 can be maintained at a pressure capable of injecting fuel, making it possible to inject a desired amount of fuel.

On the other hand, when the result at step 107 is negative, the routine goes to step 109 where the control of the electromagnetic valve 16 is executed. The control is for maintaining the fuel pressure within the accumulator 2 detected by the pressure sensor 21 near the predetermined high fuel pressure (PH). After the pressure within the accumulator 2 is elevated to near the predetermined high fuel pressure (PH), the electromagnetic valve 16 is closed for only a required period in the discharge stroke of the high-pressure pump 7, such that an amount of fuel equal to that of fuel injected into the two cylinders is supplied from the high-pressure pump 7 into the accumulator 2. For example, immediately after the start of fuel injection, however, the fuel pressure within the accumulator 2 is capable of injecting fuel but is still near the rated discharge pressure (PL) of the low-pressure pump 4, which is considerably lower than the predetermined high fuel pressure (PH). Therefore, the electromagnetic valve 16 is closed over the whole discharge stroke of the high-pressure pump, so that an amount of fuel larger than that injected into the two cylinders is supplied to the accumulator 16 and the pressure within the accumulator 2 is quickly elevated to near the predetermined high fuel pressure (PH). Thus, when the fuel pressure within the accumulator 2 detected by the pressure sensor 21 is lower than the predetermined high fuel pressure (PH), the electromagnetic valve 16 is maintained to be closed for only a required period in the discharge stroke of the high-pressure pump 7, such that an amount of fuel larger than that injected into the two cylinders is supplied into the accumulator 2.

Then, at step 110, the voltage applied to the low-pressure pump 4 is lowered, and the rotational speed of the low-pressure pump 4 is lowered to lower the discharge pressure. When the high-pressure pump 7 is normally operated at step 109, the discharge pressure of the low-pressure pump 4 does not contribute to the fuel pressure within the accumulator 2. In this step, therefore, the discharge pressure of the low-pressure pump 4 is lowered to such a degree that no vapor is generated in the fuel sucked by the high-pressure pump 7, in order to suppress the leakage of fuel at the sealing portions of the suction pipe 8.

Figure 5:
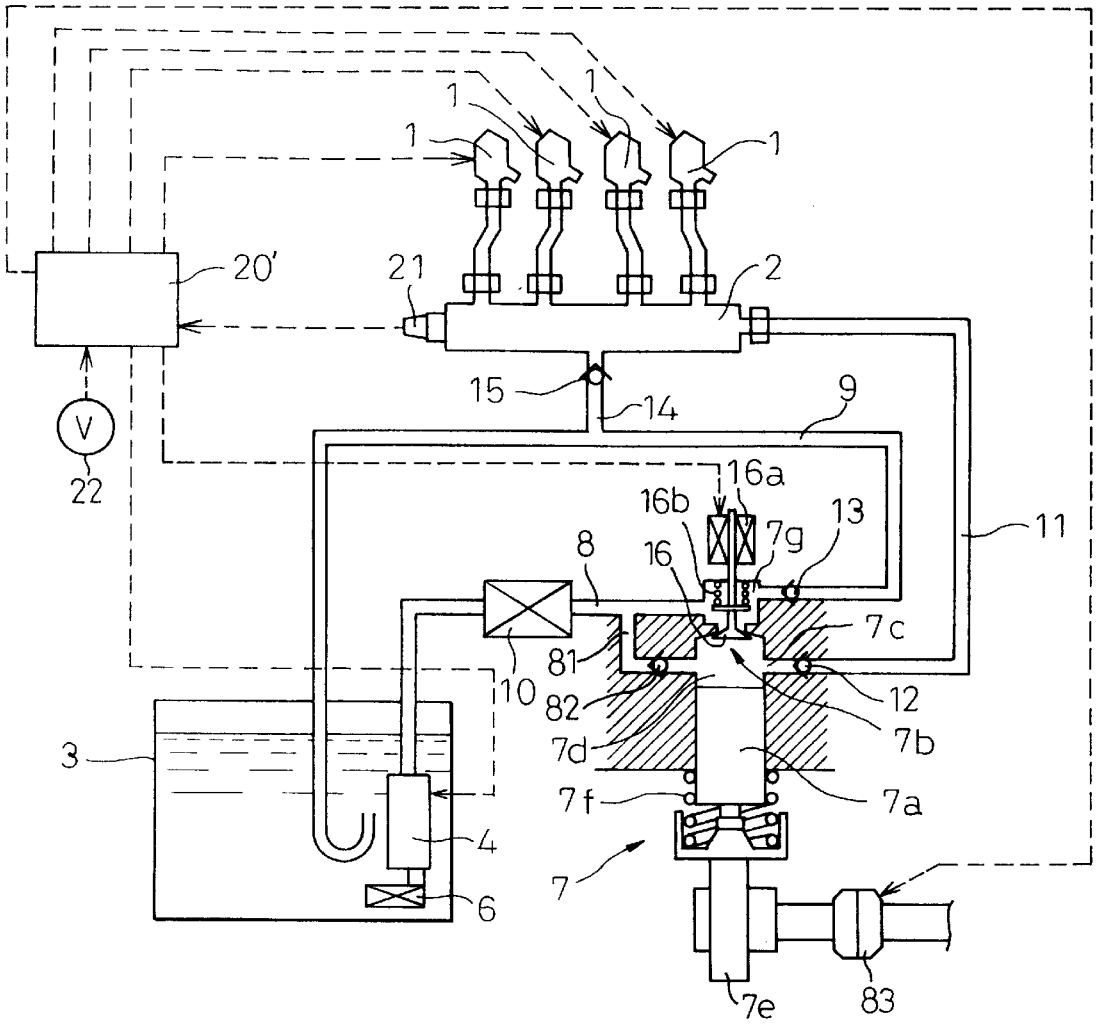
FIG. 5 is a view schematically illustrating a device for controlling fuel injection into an internal combustion engine according to a second embodiment of the present invention.

FIG. 5 is a diagram schematically illustrating the device for controlling the injection of fuel into an internal combustion engine according to a second embodiment of the present invention. Described below are only the differences from the first embodiment. In the present embodiment, a connection pipe 81 branched from the downstream side of the filter 10 in the suction pipe 8 is connected to the pump chamber 7*d* of the high-pressure pump 7, and a check valve 82 is disposed in the connection pipe 81 to permit only the flow of fuel into the pump chamber 7*d*. The check valve 82 is opened even by a small differential pressure. The rotary shaft of the cam 7*e* (diagramed being turned by 90 degrees compared to that of FIG. 1) is provided with an electromagnetic clutch 83. The electromagnetic clutch 83 is constructed such that when it is connected, the discharge stroke of the high-pressure pump 7 is not deviated from the crank angle that has been set initially.

Reference numeral 20' denotes an electronic control unit (ECU) for controlling an amount of injected fuel through each fuel injection valve 1, for controlling the operation of the electromagnetic valve 16 through the electric solenoid 16*a*, for controlling the operation of the low-pressure pump 4, and for controlling the operation of the electromagnetic clutch 83. The ECU 20' is constructed similar to the ECU 20 in the first embodiment. The fuel injection valves 1, the electric solenoid 16*a*, the low-pressure pump 4, and the electromagnetic clutch 83 are connected to the output port of the ECU 20' via each drive circuit. The sensors similar to that in the first embodiment are connected to the input port of the ECU 20'.

Figure 6:
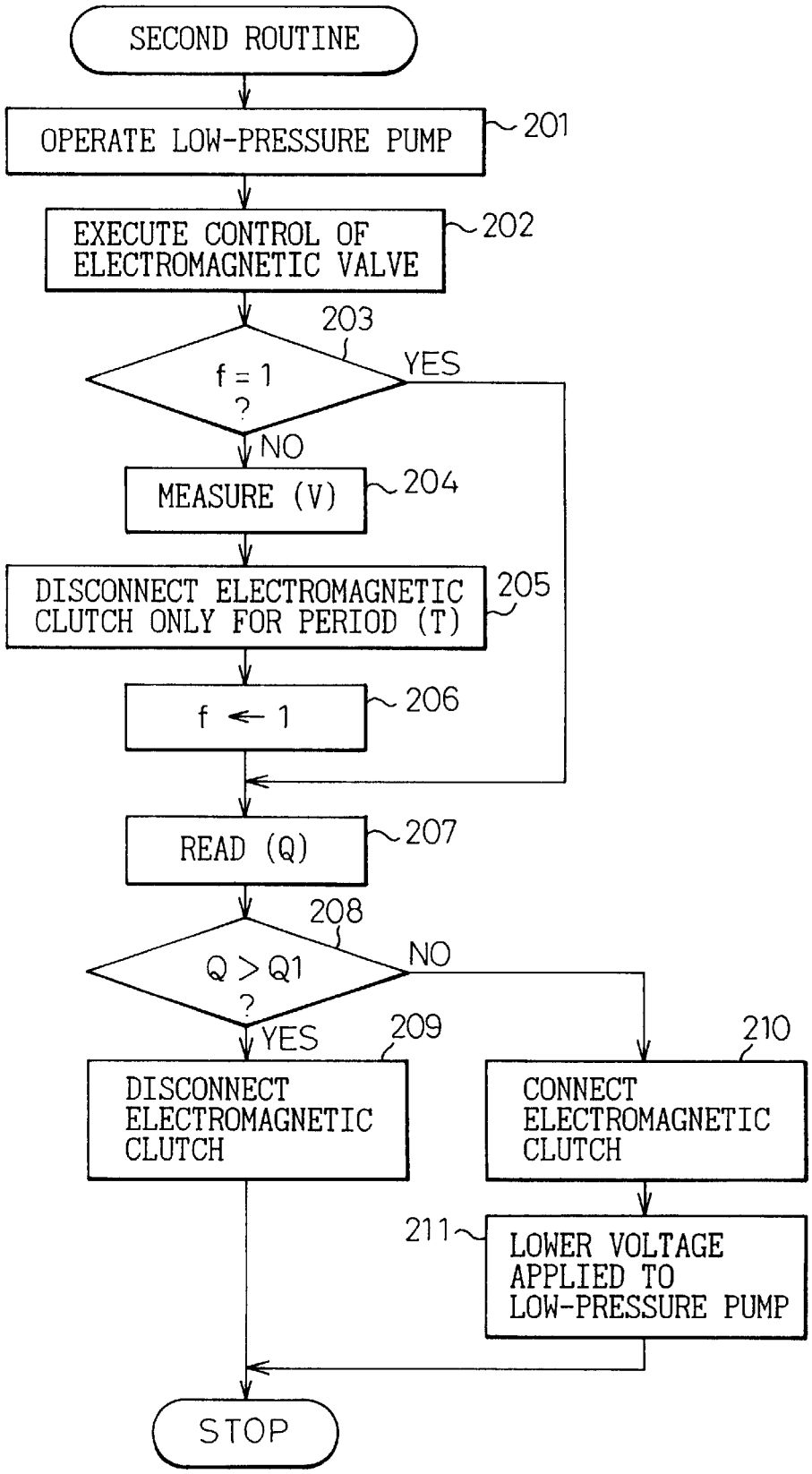
FIG. 6 is a second routine for controlling the operation of the low-pressure pump, for controlling the operation of the electromagnetic valve, and for controlling the operation of an electromagnetic clutch.

FIG. 6 is a second routine for controlling the operation of the electromagnetic valve 16, for controlling the operation of the low-pressure pump 4 and for controlling the operation of the electromagnetic clutch 83 by the control unit 20'. The second routine is executed as the starter switch is turned on, and is repeated every predetermined period. Described below are only the differences from the first routine.

In the present routine, after the low-pressure pump 4 is operated at step 201, the control of the electromagnetic valve 16 is executed at step 202 in the same manner as described above. After a current voltage (V) of the battery is measured by the voltmeter 22 at step 204, at step 205, a period (T) for elevating the fuel pressure within the accumulator 2 from the atmospheric pressure to a fuel pressure capable of injecting fuel is calculated on the basis of the fuel discharge ability of the low-pressure pump 4 that varies depending on the voltage (V) of the battery, and the electromagnetic clutch 83 is disconnected for this period (T) only.

During this period, therefore, the operation of the plunger 7*a* is halted even if the control of the electromagnetic valve 16 is executed. Therefore, the fuel pressure within the pump chamber 7*d* does not rise so as to close the check valve 82 in the connection pipe 81, and fuel discharged from the low-pressure pump 4 is substantially directly introduced into the accumulator at all times through the pump chamber 7*d* of the high-pressure pump 7. Thus, fuel pressure within the accumulator 2 can be elevated for a very short period to a fuel pressure near the rated discharge pressure (PL) at which the fuel can be injected.

After the pressure within the accumulator 2 is elevated to a fuel pressure capable of injecting fuel, it is determined if the required amount of injected fuel (Q) is larger than the maximum amount of discharged fuel (Q1) of the high-pressure pump 7 for one cylinder (at step 208) as in the first routine. When the result is affirmative, the routine goes to step 209 where the electromagnetic clutch 83 is disconnected, and a relatively large amount of fuel discharged from the low-pressure pump 4 per a unit time is substantially directly introduced into the accumulator 2. Thus, even if a large amount of fuel is injected from the accumulator 2, the fuel pressure within the accumulator 2 can be maintained nearly at a fuel pressure capable of injecting fuel, making it possible to inject a desired amount of fuel.

On the other hand, when the result at step 208 is negative, the routine goes to step 210 where the electromagnetic clutch 83 is connected and the high-pressure pump 7 starts operating. Accompanying the control of the electromagnetic valve 16, the fuel pressure within the accumulator 2 is quickly elevated from near the rated discharge pressure of the low-pressure pump 4 to near the predetermined high fuel pressure. Thereafter, the pressure is maintained to be near this predetermined high fuel pressure.

Figure 7:
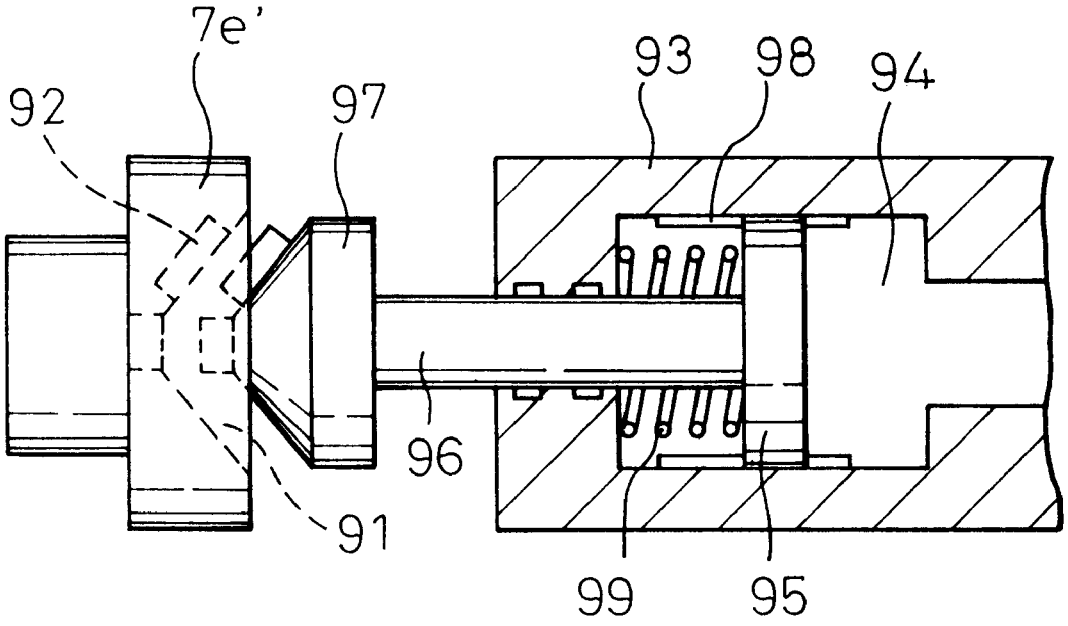
FIG. 7 is a sectional view illustrating a hydraulic clutch that can be used instead of the electromagnetic clutch of the second embodiment.

FIG. 7 is a sectional view illustrating the structure of a hydraulic clutch used instead of the electromagnetic clutch 83. In FIG. 7, a cam 7*e'* is provided with a conical recessed portion 91 concentric with the center of rotation of the cam 7*e'*. A key groove 92 is formed in the recessed portion 91 at a predetermined position. Reference numeral 93 is a rotary shaft that is rotated by the crankshaft and that has an inner space 94 formed therein. The inner space 94 is supplied with a lubricating oil from a hydraulic pump (not shown) driven by the engine in order to circulate the lubricating oil in the engine.

A piston 95 is disposed in the internal space 94, and a piston rod 96 secured to the piston 95 extends from the inner space 94 to the cam 7*e'* in an oil-tight manner to penetrate through the end of the rotary shaft 94. To the end of the piston rod 96 is secured an engaging portion 97 having a suitable shape to come into engagement with the recessed portion 91 of the cam 7*e'* and with the key groove 92. A plurality of grooves are formed in the periphery of the piston 95 so as to come into engagement with a plurality of splines 98 formed in the inner space 94 in the axial direction. Therefore, the piston 95 can slide along the inner space 94 without turning relative to the rotary shaft 93.

Moreover, a plurality of through holes (not shown) are formed in the piston 95, so that the lubricating oil can also flow into the space on the front end side of the piston 95 in the inner space 94. A spring 99 is arranged in the space on the front end side to urge the piston 95 toward the side opposite to the cam 7*e'*.

In the thus constituted hydraulic clutch mechanism, an equal pressure of lubricating oil acts on both sides of the piston 95. Here, however, the pressure-receiving area of the piston 95 on the side of the piston rod is smaller by the sectional area of the piston rod 96. Therefore, the piston 95 is urged by the lubricating oil pressure toward the cam 7*e*' at all times. At the start of the engine, however, the hydraulic pump driven by the engine rotates slowly due to the cranking, and thus the pressure of lubricating oil in the inner space 94 does not quickly rise from the atmospheric pressure. At this time, the urging force by the spring 99 is greater than the urging force by the lubricating oil pressure. Accordingly, the piston 95 moves in the direction opposite to the cam 7*e*', and the engaging portion 97 is separated away from the recessed portion of the cam 7*e'*.

Thus, even if the operation is executed for opening and closing the electromagnetic valve 16, the operation of the plunger 7*a* remains halted. Therefore, the fuel pressure does not rise in the pump chamber 7*d* to close the check valve 82 in the connection pipe 81, and fuel discharged from the low-pressure pump 4 is substantially directly introduced into the accumulator at all times through the pump chamber 7*d* of the high-pressure pump 7. Thus, at the start of the engine, the pressure within the accumulator 2 can be elevated for a very short period to a fuel pressure capable of injecting fuel, and, fuel can be injected with this fuel pressure.

As the engine speed increases after the engine start, the hydraulic pump rotates at a relatively high speed, and the pressure of lubricating oil is elevated in the inner space 94. Therefore, the urging force by the lubricating oil pressure becomes larger than the urging force by the spring 99, whereby the piston 95 moves toward the cam 7*e*', and the engaging portion 97 comes into engagement with the recessed portion of the cam 7*e*' so that the rotation of the rotary shaft 93 is transmitted to the cam 7*e*'. Then, the high-pressure pump 7 starts operating, the fuel pressure within the accumulator 2 is quickly elevated from near the rated discharge pressure of the low-pressure pump 4 to near the predetermined high fuel pressure accompanying the control of the electromagnetic valve 16 and, thereafter, the fuel pressure is maintained to be nearly the predetermined high fuel pressure.

In the hydraulic clutch mechanism, the discharge stroke of the high-pressure pump 7 is not deviated from the initially set crank angle when the clutch mechanism is engaged owing to the shapes of the key groove 92 in the cam 7*e*' and the engaging portion 97 that engages with the key groove. By using the fluid pressure-type clutch by which the high-pressure pump is connected to the drive source only when the fluid pressure produced by the fluid pump driven by the engine becomes greater than a predetermined value, it is possible to substantially directly introduce fuel discharged from the low-pressure pump 4 into the accumulator at the start of the engine without the control operation for maintaining the electromagnetic valve 16 of the high-pressure pump 7 to be opened or without the control operation for disconnecting the clutch.

In the above-mentioned first and second embodiments, the return pipe 9 may be omitted. In this case, the excess fuel from the high-pressure pump is returned back to the fuel tank 3 through the suction pipe 8 during the normal engine operation. The first embodiment has used the electromagnetic valve 16 of the high-pressure pump 7 as an opening and closing valve that is opened to guarantee the communication between the discharge side of the low-pressure pump 4 and the pump chamber 7*d* of the high-pressure pump 7 at the start of the engine. Not to be limited thereto, however, it is also allowable in the present invention to provide, for example, a connection pipe 82, as in the second embodiment, to form a suction passage for communicating the discharge side of the low-pressure pump with the suction side of the high-pressure pump, and provide the suction passage with another opening and closing valve.

What is claimed is:

1. A device for controlling fuel injection into an internal combustion engine comprising:

a accumulator for supplying pressurized fuel to a fuel injection valve;

a high-pressure pump for discharging fuel into said accumulator using the engine as a power source; and a low-pressure pump for discharging fuel into said high-pressure pump using a power source other than the engine;

at the start of the engine, the fuel discharged from said low-pressure pump being substantially directly introduced into said accumulator through a pump chamber of said high-pressure pump;

wherein an opening and closing valve is provided in a suction passage that communicates the discharge side of said low-pressure pump with the suction side of said high-pressure pump, and said opening and closing valve is maintained to be opened at the start of the engine.

2. A device according to claim 1, wherein said opening and closing valve also works as an overflow valve that is opened for preventing said high-pressure pump from discharging an amount of fuel larger than a required amount of fuel into said accumulator in the discharge stroke of said high-pressure pump.

3. A device for controlling fuel injection into an internal combustion engine comprising:

a accumulator for supplying pressurized fuel to a fuel injection valve;

a high-pressure pump for discharging fuel into said accumulator using the engine as a power source; and a low-pressure pump for discharging fuel into said high-pressure pump using a power source other than the engine;

at the start of the engine, the fuel discharged from said low-pressure pump being substantially directly introduced into said accumulator through a pump chamber of said high-pressure pump;

wherein a check valve is provided in a suction passage that communicates the discharge side of said low-pressure pump with the suction side of said high-pressure pump to permit only the flow of fuel from said low-pressure pump into said high-pressure pump, and a high-pressure pump halting means is provided for halting the operation of said high-pressure pump at the start of the engine.

4. A device according to claim 3, wherein said high-pressure pump halting means is an electromagnetic clutch disposed between said high-pressure pump and the power source for said high-pressure pump.

5. A device according to claim 3, wherein said high-pressure pump halting means is a clutch mechanism disposed between said high-pressure pump and the power source for said high-pressure pump, and said clutch mechanism couples said high-pressure pump to the power source of said high-pressure pump only when the fluid pressure produced by the fluid pump using the engine as a power source becomes greater than a predetermined value.

6. A device according to claim 5, wherein said fluid pump is a lubricating oil pump for the engine.

7. A device according to claim 1, wherein the rotational speed of said low-pressure pump is increased at the start of the engine compared with that of during normal engine operation.

8. A device according to claim 1, wherein said engine is a direct cylinder injection type spark-ignition internal combustion engine.

9. A device according to claim 1, wherein said engine is a diesel engine.

10. A device according to claim 3, wherein the rotational speed of said low-pressure pump is increased at the start of the engine compared with that of during normal engine operation.

* * * * *